United States Patent [19]

Hofmann

[11] 4,248,656

[45] Feb. 3, 1981

[54] DEVICE FOR MANUFACTURING AN INSULATING GLASS PLATE

[75] Inventor: Fritz Hofmann, Herzogenbuchsee, Switzerland

[73] Assignee: Glasmatec AG, Thun, Switzerland

[21] Appl. No.: 906,418

[22] Filed: May 16, 1978

[30] Foreign Application Priority Data

May 16, 1977 [CH] Switzerland ..... 6079/77

[51] Int. Cl.[3] ..... B30B 15/06; B30B 15/22; B30B 15/30

[52] U.S. Cl. ..... 156/358; 100/215; 100/218; 100/257; 156/107; 156/360; 156/378; 156/380; 156/497; 156/559; 156/563; 156/580

[58] Field of Search ..... 156/107, 285, 351, 358, 156/360, 497, 539, 580, 556, 583.8, 378, 64, 380, 559, 563; 100/93 P, 215, 218, 257

[56] References Cited

U.S. PATENT DOCUMENTS

| | | | |
|---|---|---|---|
| 2,774,700 | 12/1956 | Killington | 156/580 |
| 3,036,947 | 5/1962 | Marra | 156/580 |
| 3,211,085 | 10/1965 | Zeppetello | 100/257 |
| 3,340,795 | 9/1967 | Hartley | 156/580 |
| 3,455,082 | 7/1969 | Feigel | 156/360 |
| 3,522,129 | 7/1970 | Crathern | 156/364 |
| 3,562,067 | 2/1971 | Kucheck | 156/285 X |
| 4,032,387 | 6/1977 | Sugiyama et al. | 156/285 X |
| 4,097,326 | 6/1978 | Giulie et al. | 100/218 X |
| 4,103,611 | 8/1978 | Carlsson | 100/257 |

FOREIGN PATENT DOCUMENTS

| | | | |
|---|---|---|---|
| 1454685 | 11/1976 | United Kingdom | 156/107 |

*Primary Examiner*—Michael G. Wityshyn
*Attorney, Agent, or Firm*—Michael J. Striker

[57] ABSTRACT

A device for manufacturing laminated insulating glass plate bonded by adhesive, comprising a supporting table adapted for receiving glass sheets and interspaced spacer frames covered with an adhesive or adapted for soldering. A compression plate is arranged for lifting and lowering movement above the supporting table and is provided with a suction arrangement for raising a glass sheet and compressing it against a spacer frame glass sheet preassembly delivered on the supporting table. The device further comprises a feeding track, a washing device and a device for assembling the spacer frames.

44 Claims, 15 Drawing Figures

Fig. 9
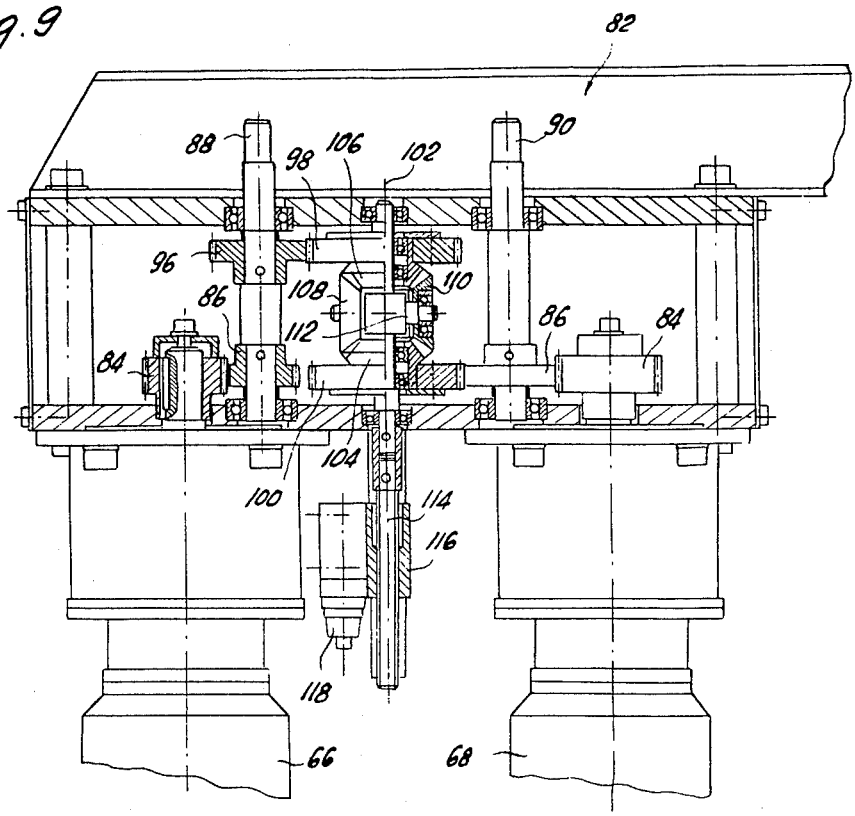
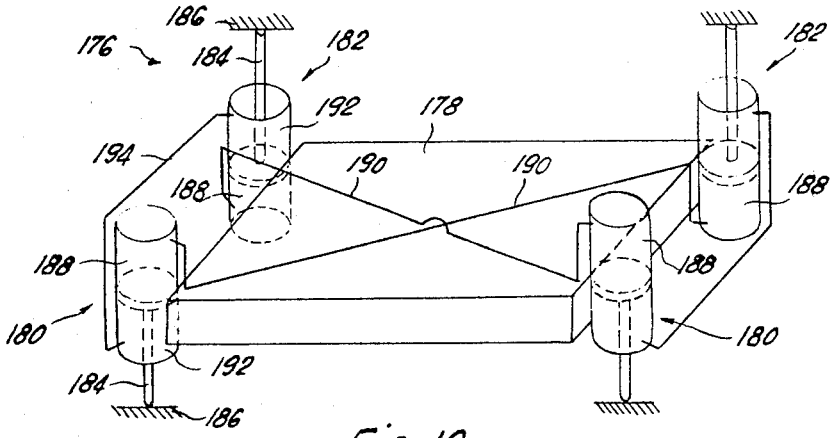
Fig. 10

Fig. 12
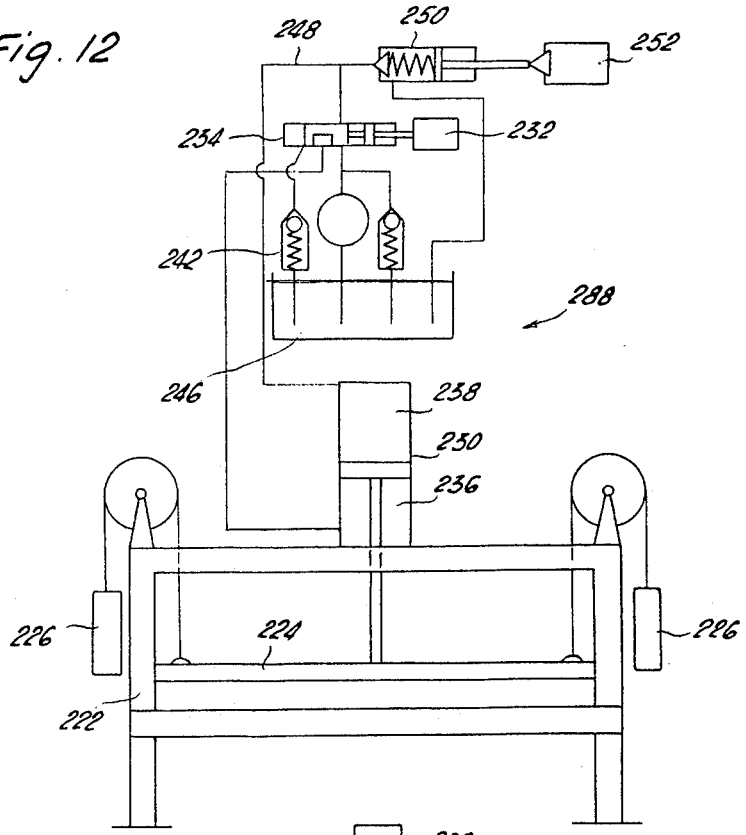
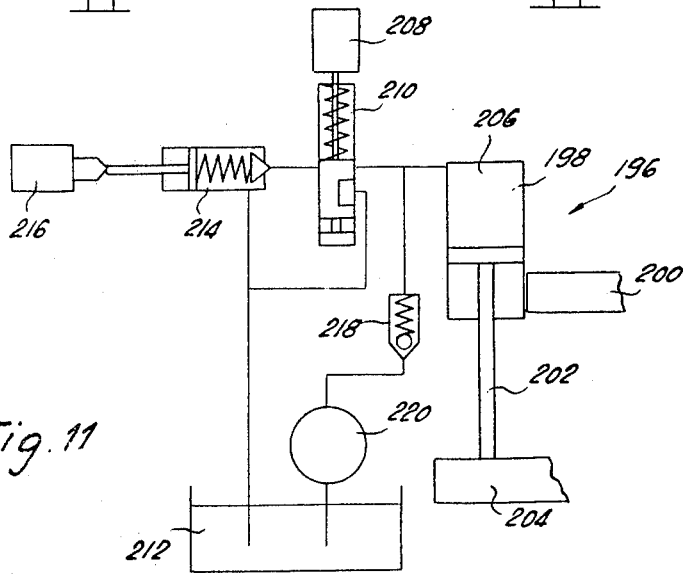
Fig. 11

DEVICE FOR MANUFACTURING AN INSULATING GLASS PLATE

BACKGROUND OF THE INVENTION

This invention relates generally to manufacturing of insulating glass plates and more particularly, it relates to an improvement in the manufacturing of layered insulating glass plates assembled of compressed layers of individual glass sheets and interposed spacer frames.

In manufacturing laminated insulating glass plates, frames made of a profiled material are inserted between the individual glass sheets to serve for spacing the sheets one from the other. The surfaces of the frame that come into contact with the glass sheets are covered with an adhesive agent such as, for example, a butyl adhesive. Upon assembling an insulating glass plate from the individual glass sheets and the spacing frames interposed therebetween the blank has yet to be compressed to bring it to the final size. For this purpose, a power press is known wherein a preassembled insulating glass plate blank is fed between rotary pressing rollers by which is compressed to the final shape. The disadvantage of such known rotary power press resides in the fact that the rollers have to be very carefully adjusted since the insulating glass plate blank is compressed successively. Moreover, the working cycle of the rotary power press depends on the size of the insulation glass plate blank. Consequently, a wide variety of working cycles results and, since the working cycles for assembling the insulating glass plate blanks are independent from the size of the glass sheets, an intermediate store has to be provided to assist the rotary power press.

Also in the manufacture of insulating glass plates assembled of two single glass sheets with an interposed spacer frame of metal that has to be soldered to the glass sheets, it is necessary to press together the two single glass sheets so that the soldering process might take place over the entire length of the spacer frame. The soldering is effected by means of electrical current, high frequency heating or resistance heating, and is to be made simultaneously on the whole area to be joined. This soldering process that by itself is known from the German publication DT-OS 25 10 849, is unsuitable for use in the rotary power press.

SUMMARY OF THE INVENTION

It is, therefore, an object of the invention to avoid the aforementioned disadvantages of prior art rotary power devices. In particular, an object of this invention is to provide a device for manufacturing insulating glass plate that makes it possible to exert a uniform pressure simultaneously against the whole surface of the glass plate.

Another object of this invention is to provide a device that in addition to the compression of the individual glass sheets serves also for assembling the latter and spacer frames into glass plate blanks.

In keeping with these objects, and cthers which will become apparent hereafter, one feature of the invention resides, in a device for manufacturing an insulating glass plate, in a combination which comprises a supporting table that is adopted for supporting at least one glass plate and a compression plate arranged for lifting and lowering movement above and parallel to the surface of the supporting table. Preferably, the device of this invention forms a part of an apparatus for assembling individual glass sheets and including a feeding track, a washing device and an assembling device for spacer frames.

By virtue of the fact that the device of this invention is provided with a stationary supporting table cooperating with a compression plate arranged for lifting and lowering movement above the table, the insulating glass plate blank that consists for example of two individual glass sheets and a spacer frame cemented therebetween can be compressed uniformly and simultaneously over its entire surface. As a result, local tensions in the glass are eliminated and due to the uniformity of compression a uniform thickness of the final insulating glass plate is attained. Furthermore, the device of this invention enables uniform working cycles no matter whether small or large insulating glass plate blanks are being processed. It is also possible if the case rises, to compress two or more insulating glass plate blanks simultaneously.

The device of this invention makes it also possible to manufacture insulating glass plates where a metal spacer frame is disposed between two single glass sheets by soldering the glass sheets to the frame simultaneously over the entire length of the blank. As known from the German publication No. DT-OS 25 10 849, soldering electrodes are employed through which a current for heating the spacer frame is applied.

The device of this invention is designed so as to produce a uniform compression force for all sizes of the insulating glass plates to be manufactured. Especially in insulating glass plates having cemented or glued spacer frames the equalization of compression can be achieved so that for larger insulating glass plates the compression force is applied for a longer time than in the case of smaller insulating glass plates. Generally it is advantageous when the device of this invention is provided with an adjusting device for adjusting the compression force of the compression plate. The adjustment of the compression force can be made gradually whereby for insulating glass plates in a certain group of sizes the generated compression force is uniform and is changed step-wise only then when one group of sizes is changed to another group of sizes. It is particularly advantageous when the adjusting device adjusts the compression force of the compression plate according to the length of edges of each glass plate. In this manner it is possible to adjust for any insulating glass plate in process the optimum compression force. This measure has proven particularly advantageous in the case when the device is employed for manufacturing insulating glass plates by soldering the spacer frame between the individual glass sheets simultaneously over the entire length of the glass plate blank by the application of electric current. In this case the compressing force has to be very carefully applied to the insulating glass plate blank in order to adjust the force to the softening of the spacer frame. It is also of advantage when the device of this invention is provided with a device for determining the length of edges of the adjacent sides of the plate. In manufacturing insulating glass plates where the spacer frame is simultaneously soldered along its entire length to the individual glass sheets between which the frame is disposed, it is advantageous when the device of this invention includes such an arrangement of electrodes that makes it possible to apply simultaneously either by hand or preferably automatically two electrodes on the spacer frame.

Even if the device of this invention can operate without guide members for the plate, it is advantageous to provide the supporting table at its two adjacent sides with guiding means for the glass plate blank to facilitate an exact positioning thereof for the subsequent treatment. The guiding means can be fixedly mounted especially when the compression plate engages the glass sheets within the limits of the guiding means. Nonetheless it is more advantageous for the compressing process when the compression plate overlaps the edges of the glass plate. In this case the guides are preferably constructed so that they can be lowered under the plane of the supporting table. In order to facilitate a continuous production flow along the supporting table, the guides are with advantage arranged at the discharge side of the supporting table and adapted for being retracted by means of a retracting device so that the glass plate could be manipulated without obstructions. Especially advantageous embodiment includes a plurality of guiding rollers having shafts which are shiftably supported on the supporting table and are resilintly held in their guiding position by means of springs. For transporting the plate a number of guiding rollers arranged in the discharging direction can be positively driven.

In one embodiment the supporting table is constructed as a roller table or in other words, as a table on the surface of which are areas with guiding and driving rollers which are biased by springs so that upon application of pressure they resiliently retreat. Preferably, the supporting table is designed as an air cushion table which is inclined toward the corner at which the guiding means intersect. By this measure it is granted that the incoming glass sheets automatically adjust themselves to the guides. To prevent incoming glass sheets from recoiling on the guide, the supporting table is provided with a braking device for braking the fed glass sheets before the latter reach the guides. For this purpose, a sensor such as a light gate is arranged in a corner area of the supporting table. Upon the arrival of the plate the sensor shuts off the supply air for the air cushion in the table. The sensor actuates for example a valve that interrupts the air supply. As a result, the incoming glass sheet abuts against the table and is automatically braked.

The aforementioned device for determining the length of the glass sheet can be designed in any suitable known manner. Preferably, sensors responding to the glass sheet can be arranged along the guiding means whereby the number of the sensors actuated by the bypassing glass sheet indicates the approximate measure of the length of the sheet.

A more accurate determination of the length is possible when a length measuring device is provided having at each guide a movable probe or sensor travelling with the glass sheet to indicate the accurate distance of its travel. This movable sensor can be located for example at a starting point at the corner of the supporting table opposite to the corner where the guiding tracks meet together. In this way, the probe indicates directly the length of an edge of the sheet. Still more advantageous is the arrangement where the starting position of the sensor or probe is located at the edge where the guides intersect whereby the path of displacement is an indirect measure for the length of edges of the glass sheet. The latter embodiment of the device for the length determination is particularly recommended there where not only the length of the edge has to be defined but also the length of the edge of the sheet opposite to the corner where the guides intersect each other as it will be explained below in connection with the description of the arrangement of soldering electrodes.

For driving the sensors, two sliding carriages are provided having a common drive to which the carriages are coupled by means of couplings. In a preferred modification, however, each sliding carriage has a separate drive. The drive is for example an electromotor arranged on the carriage and having a tooth gear engaging a rack mounted on the supporting table. In a preferred embodiment, a rotating traction device such as for example a rotary chain drive is provided in the path of displacement of the sensors and the sliding carriage is connected thereto.

The evaluation of the path of displacement of the sensors can be effected in different ways. For example it is possible that a signal generator is assigned to each sensor to generate signals the number of which is proportional to the displacement of the sensor. The signals are counted in a counting device and evaluated. Especially in controlling the compressing force in response to the measured length of the glass sheet it is required that the length determined by each sensor of the length evaluating device be summed up. To this end, the device for the determination of length is provided with a summer. Such a summer or summing device can be in the form of an electrical circuit in which, for example, the signals generated during the displacement of respective sensors are summed up. The summer can be made also in the form of a mechanical device in which the drives for the sensors are coupled to a summing differential gear. The summer differential gear drives a threaded spindle carrying a screw nut that displaces a stop or a limit switch proportionally to the summed up length of the edges. A device for adjusting the compressing force of the compression plate is connected and controlled by this stop or limit switch.

The sensors are fixedly mounted on the slidable carriages. By means of an actuation member controlled hydraulically, for example, the sensors can be moved into and out of the area between the supporting table and the compression plate.

The soldering device for securing metal spacer frames to the adjacent glass sheets includes two electrodes each arranged on a slidable carriage movable along the guides. The electrodes are applicable to diagonally juxtaposed points on the spacer frame when the latter is disposed between two individual glass sheets. The starting position of the path of movement of the electrodes is preferably opposite to the corner where the guides intersect each other. The electrodes, controlled by an actuating member, are displaceable to and from the area between the supporting table and the compression plate. The electrodes can be made in the form of pins or rods that are pressed against the spacer frame. Preferably, however, the electrodes include, respectively, two electrode portions biassed against each other by means of a spring and extendable in vertical direction by means of an actuation member. In this manner, the vertical position of the electrodes can be adjusted by the actuation member which can be designed as an electric, pneumatic or preferably a hydraulic device.

During the soldering operation, the electrodes can be moved to contact any point on the spacer frame. In the preferred embodiment, the electrodes are arranged so as to contact the spacer frame at those points that with respect to the path of electric currents at least approximately produce symmetrical distribution of the currents. By this means a uniform heating of the spacer frame is achieved. In addition, it is also of advantage when one electrode is perpendicular and the other electrode approximately parallel with respect to the contact surface of the frame.

The device for determining or evaluating length as well as the soldering device can be made as separate units but with advantage, it is possible to combine these two devices so that for each electrode and for each sensor a common sliding carriage is employed. The sensors in this modification are adapted for controlling the movement of the electrodes.

Various devices can be devised for the parallel guidance of the compression plate. For example, a hydraulic device can be used in connection with a parallel guiding construction having four piston-and-cylinder units arranged between the compression plate and a stationary support so that the piston rods alternately lift and lower the compression plate. One pressure space of each cylinder is connected to a corresponding pressure space of the diagonally opposed cylinder whereas the other pressure space of each cylinder is connected with a corresponding pressure space of the adjacent cylinder. In a variation, the parallel guiding construction includes tooth racks arranged on pivots on a stationary support whereby the compression plate supports pinions that are torsion-free connected to each other via shafts and an intermediate driving gear. A particularly simple embodiment results when the compression plate is guided on upright pillars of the stationary support and held parallel to the supporting table by means of a parallelogram construction.

For lifting and lowering the compression plate a mechanical, hydraulical or pneumatical lifting-and-lowering device is provided. Preferably, the construction of this device is such that the weight of the compression plate is compensated by means of counterweights so that the compressing force corresponds to the force that is exerted on the compression plate by the lifting and lowering device only. According to the preferred embodiment, the weight of the compression plate assists in compressing action whereby the compressing force is adjusted by changing the counterweight. For this purpose, the compression plate is supported by a supporting rod of the lifting and lowering device upon a supporting spring whereby the adjusting device for setting the compressing force has a limit switch responsive to movement of the spring such that it turns off the lifting and lowering device when the pressure on the supporting spring is relived. In the hydraulic variation, a piston-and-cylinder unit is provided wherein the pressure space of the cylinder that is loaded by the weight of the compression plate is connected to a pressure regulating valve the control pressure of which is adjustable. It is also of advantage when the adjustment of the compressing force by means of the device for determining the length of the sheet, is also controllable so that the compressing force can be controlled in response to the actual length of edges of the glass sheet.

The device according to this invention can be designed so as to finish preassembled insulating glass plate blanks only. In the preferred embodiment, however, the device of this invention is constructed for taking an active part in assembling the insulating glass plate blank. In this case the compression plate is constructed as a suction plate for lifting an insulating glass sheet so that after the glass sheet is conveyed onto the supporting plate, the suction-and-compression plate takes it over and lifts it up. In this condition, another insulating glass sheet together with a preassembled spacer frame is conveyed onto the supporting table and by lowering the suction-and-compression plate the raised glass sheet is compressed against the underlying preassembled spacer frame-and-glass sheet assembly. The spacer frame can be either glued to the insulating glass sheet or as mentioned above, the glass sheets are instantly soldered to the spacer frame along the whole length of the insulating glass plate blank. In order to facilitate the disconnection of the glass sheet from the suction device on the compression plate, the suction device is provided with switching means that either shuts off the suction air from the suction and compression plate or delivers a blow air under the lifted glass sheet.

In the operation of the device of this invention, it is of advantage when the stroke of the compression plate is adjustable. For this purpose, there is provided a sensor cooperating with a limit switch for adjusting the path of lifting of the compression plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 9 is a sectional front view of a summing device including a summing differential gear, taken along line IX—IX in FIG. 5, on an enlarged scale;

FIG. 10 is a schematic perspective view of a device for parallel guiding of the compression plate;

FIG. 11 is a schematic side view of a lifting and lowering device for the compression plate including an adjusting device for compressing force;

FIG. 12 is a schematic diagram of another embodiment of the lifting and lowering device including counterweights for the compression plate and an adjusting device for the compression force;

DESCRIPTION OF THE PREFERRED EMBODIMENTS

Figure 1:
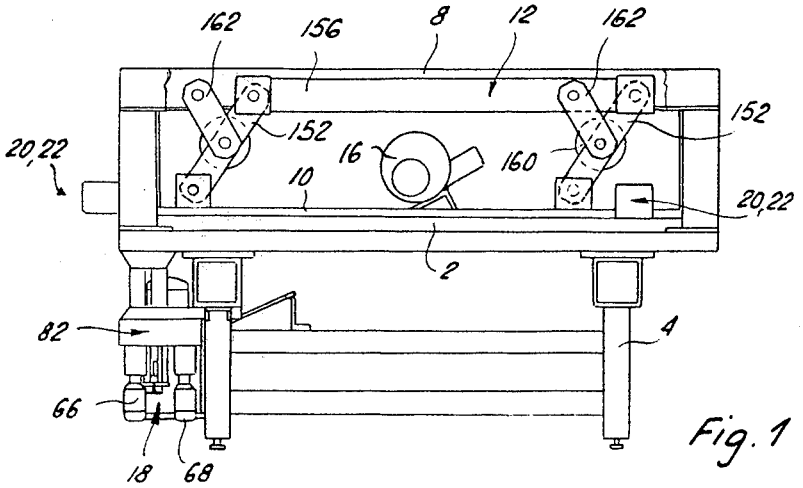
FIG. 1 is a side view, partially in section, of the device for manufacturing an insulating glass plate according to this invention.
Figure 2:
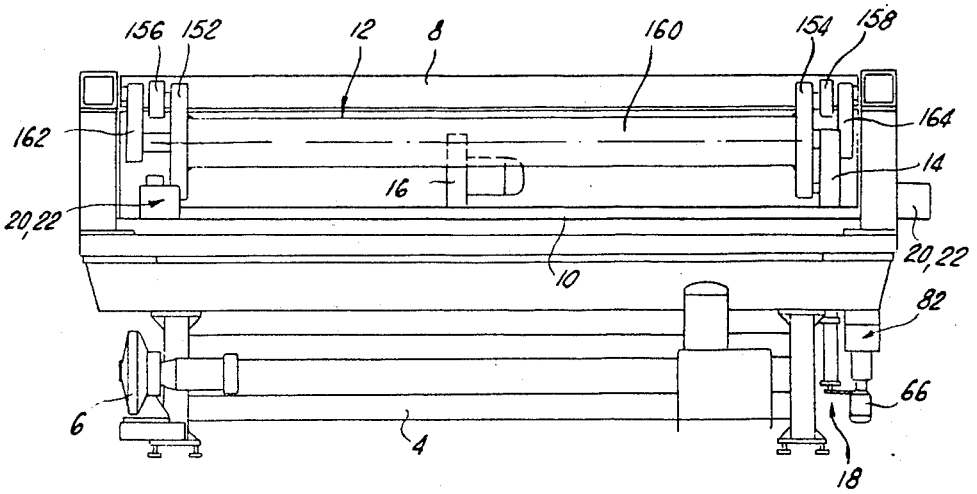
FIG. 2 is a front view, partly in section of the device according to FIG. 1.
Figure 7:
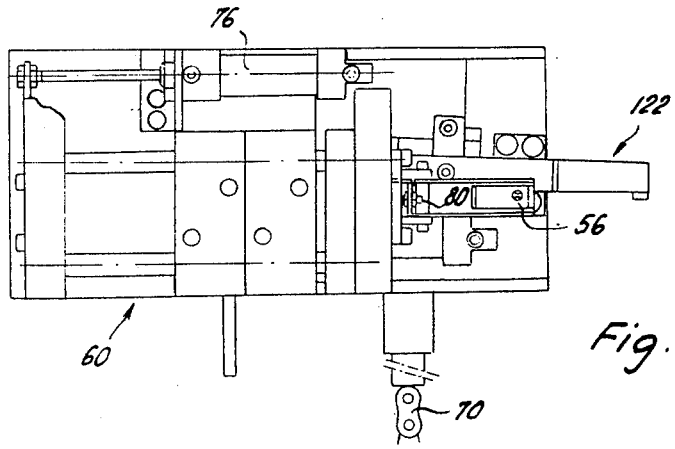
FIG. 7 is a sectional top view of the sliding carriage of FIG. 6 taken along line VII—VII of FIG. 6.
Figure 8:
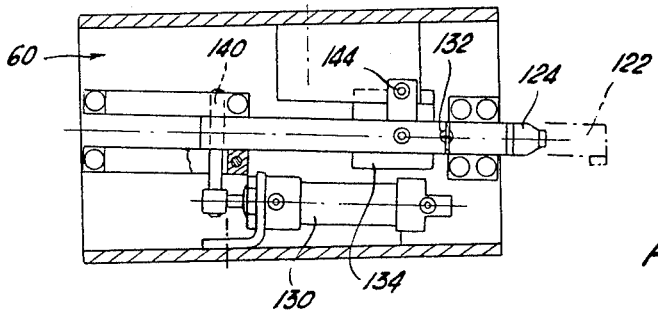
FIG. 8 is a sectional top view of the sliding carriage of FIG. 6 taken along line VIII—VIII.

Referring firstly to FIGS. 1 and 2, the device for manufacturing an insulating glass plate includes a supporting table 2 designed as an air cushion table resting on a stand 4 and including an air blower 16 for delivering a stream of air for the air cushion. A compression plate 10 extends above and parallel to the supporting table 2 and is supported for lifting and lowering movement on a parallel guide construction 12 that in turn is supported on a supporting frame 8. A lifting and lowering device 14 controls the movement of the compression plate 10. The blower 16 is disposed on the plate 10 and serves for producing a suction effect on the compression plate 10. A switching device 17 (shown in FIG. 3) is employed for turning off the suction and alternatively, for applying blow air on the compression plate 10. An adjustment device 18 adjusts the compressing force of the compression plate 10 against the supporting table 2. Furthermore, the device of this invention is equipped with soldering device 20 adapted for applying two electrodes against a spacer frame interposed between two single glass sheets as it will be explained in greater detail below in connection with FIGS. 6–8. In addition, the device of this invention includes a length determining device 22 designed for measuring the length of edges of adjacent sides of a glass sheet to be processed. The length determining device serves also for positioning the electrodes of the soldering device 20 and moreover for directing the adjusting device 18 to adjust the compressing force of the compression plate 10 according to the length of the glass sheets in process.

Figure 3:
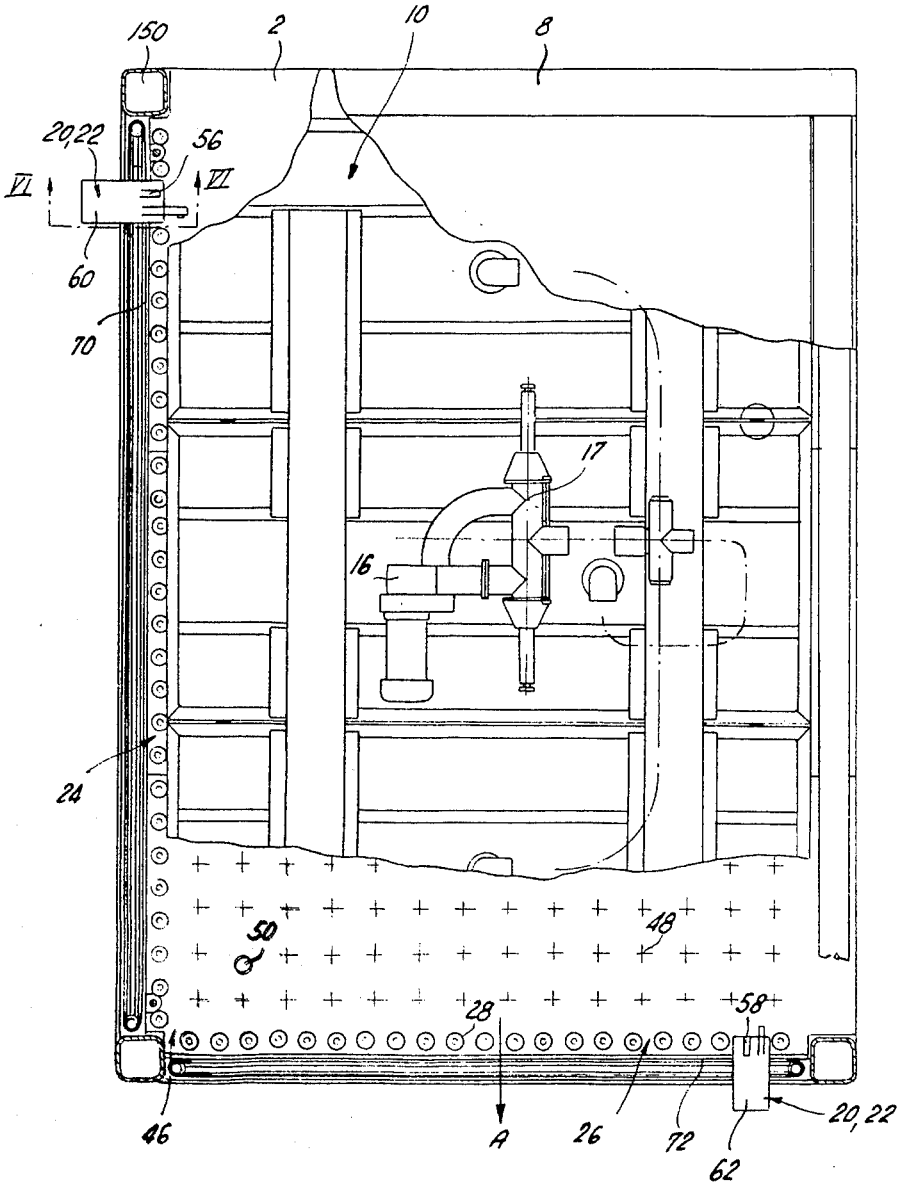
FIG. 3 is a top view, partly in section, of the device of FIG. 1 shown on an enlarged scale.
Figure 4:
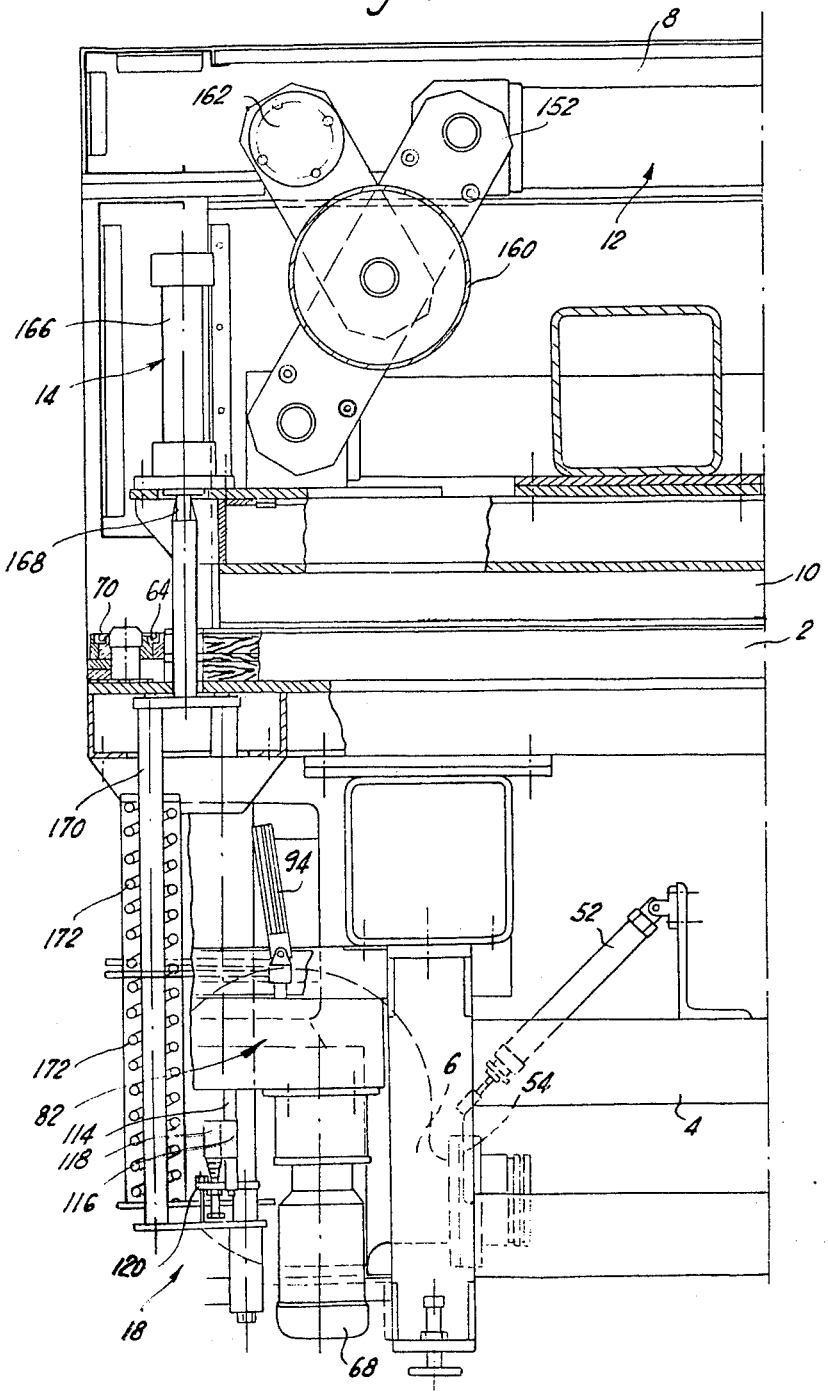
FIG. 4 is a cut away side view of the left-hand side of the device of FIG. 1, shown on enlarged scale.
Figure 5:
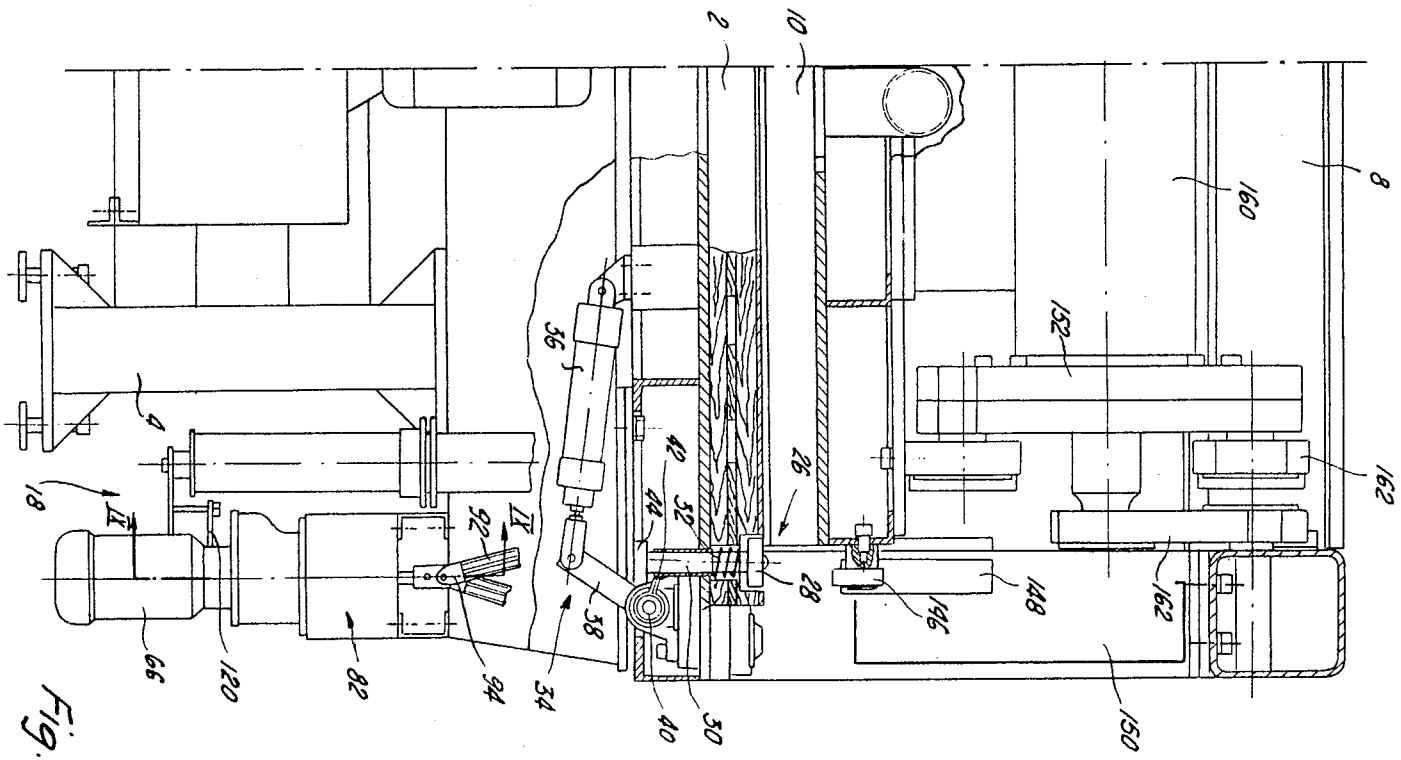
FIG. 5 is a cut away side view of the right-hand side of the device of FIG. 1, shown on enlarged scale.

Supporting table 2, as can be seen from FIGS. 3–5, includes guides 24 and 26 arranged along two adjacent sides of the table. The guides are provided, respectively, with guiding rolls 28 the axes of which are movably supported on the supporting table 2 and by means of springs 32 are held in their guiding position. Arrow A indicates discharging direction and the guiding rollers 28 extending transversely to the discharging direction can be lowered under the supporting surface of the supporting table 2 by means of a retracting device 34 so that the finished insulating glass plate can be discharged without obstructions. As shown in FIG. 5, the retracting device 34 consists of a hydraulically operated piston-cylinder unit 36 joined to a lever 38 that is connected to a shaft 40. The shaft 40 supports a control strap 42 that upon turning the lever 38 abuts against discs 44 provided on shafts 30 of guiding rollers 28. By this action, the guiding rollers are retracted against the force of biasing springs 32. At least a part of the guiding rollers 28 of the guide 24 arranged in the discharging direction A are driven by a conventional driving means (not shown in the drawing).

The supporting table 2 is in the form of an air cushion table and is inclined in the direction of corner 46 in which the guides 24 and 26 intersect each other. Air blower 6 delivers a jet of air via suitable conduits (not shown) to air vents 48 provided in the supporting table. To brake the incoming glass sheet before it reaches the guides 24 and 26, the supporting table is further provided with a braking device that includes a sensor 50 arranged in the corner area 46. The sensor 50 can be made in the form of a light gate or light barrier for example, and as can be seen from FIGS. 3 and 4, it controls an actuating device 52 for a valve 54 that turns off the blow air when actuated. The actuation device 52 is constructed as a hydraulic piston-cylinder unit.

Figure 6:
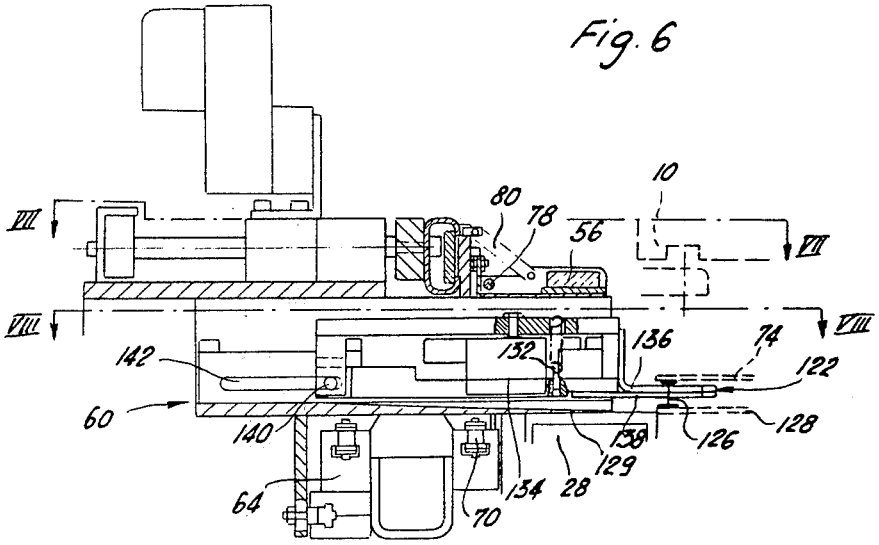
FIG. 6 is a side view of a sliding carriage for carrying an electrode and a sensor, taken along line VI—VI of FIG. 3, on an enlarged scale.

As seen particularly in FIGS. 3 and 6, length determining device 22 comprises feelers or sensors 56 and 58 arranged respectively at each guide 24 and 26 and are movable therealong to measure the edge length of the processed glass sheet. The sensors 56 and 58 are supported, respectively, on sliding carriages 60 and 62. The carriages are movable on guiding tracks 64 arranged on the supporting table 2 along the guides 24 and 26, and are driven by driving motors 66 and 68 and by rotary traction members in the form of chains 70, 72, respectively. The starting position of the feelers or sensors is always juxtaposed to the corner 46 of the intersecting guides 24 and 26. The sensors 56 and 58 are made in the form of optical feelers arranged so as to respond to a glass sheet 74 before it is siezed by the compression plate 10 and raised as indicated by dash-and-dot lines in FIG. 6. In order that the sensors 56 and 58 could reach the area between the supporting table 2 and the compression plate 10, they are shiftably arranged on the respective sliding carriages 60 and 62 and can be displaced by means of a control member 76 that is preferably designed in the form of a hydraulic piston-cylinder unit. The sensors 56 and 58 are tiltably supported on a horizontal shaft 78 and held in position by springs 80 so that in the event that the compression plate is lowered prematurely they turn aside and are thus protected against damage.

The length determining device measures the length of edges of the processed glass sheet 74 indirectly. It determines the displacement needed for detecting a glass sheet 74 so that the maximum possible displacement minus the actual displacement results in the detected length of edge of the glass sheet. The length determining device 22 is provided with a summing device 82 designed in the form of a summing differential gear that as seen particularly in FIG. 9, couples together the driving motors 66 and 68 for the sensors 56 and 58. Each driving motor 66 and 68 drives via a gear pair 84 and 86 an intermediate shaft 88 and 90 that in turn drives via a hinged shaft 92 and 94 the pull or traction members 70 and 72. Each intermediate shaft 88 and 90 drives via a gear wheel 96 and 86 another gear wheel 98 and 100 of the summing differential gear unit. The gear wheels 98 and 100 are freely rotatable on a shaft 102 and are firmly connected to a bevel gear 104 and 106. The bevel gears 104 and 106 engage other bevel gears 108 and 110 that are freely rotatable on a common transverse axis 112 extending transversely to the shaft 102 and being fixedly connected thereto. The shaft 102 drives a threaded spindle 114 that supports a threaded nut 116. A limit switch 118 is mounted on the threaded nut 116 and is displaced proportionally to the length of travel of the sensors 56 and 58. The larger is the distance of travel of the sensors 56 and 58, the smaller is the length of edge of the treated glass sheet and the further the end switch 118 is moved downwardly. The end switch 118 cooperates with a stop member 120 of an adjusting device 18 for adjusting the compressing force and turns off the lifting and lowering device 14 when actuated as it will be explained in greater detail below.

The soldering device 20 includes two electrodes 122 and 124 that are also arranged on the sliding carriage 60 and 62 for supporting the sensors 56 and 58. The electrodes are arranged so as to engage approximately diagonally juxtaposed points on the spacer frame 126 that is disposed between two glass shets 74 and 128. The electrodes 122 and 124 are shiftably arranged on the sliding carriage 60 and 62 so that they are operable for movement into and out of the space between the supporting table 2 and the compression plate 10. To facilitate the adjustment of the vertical position of electrodes 122 and 124 as may be required for different heights of the spacer frame 126, the sliding carriages 60 and 62 are provided with cams 129 that in the case of overriding depress the guiding rollers 28. An actuating member 130 in the form of a hydraulic piston-cylinder unit is designed for driving the electrodes. Each electrode 122 and 124 has two electrode portions 136 and 138 pressed against each other by means of a spring 132. The two electrode portions can be spaced apart in vertical direction by an additional actuation member 134. Each electrode 122 and 124 is tiltable about a horizontal axis 140 extending approximately parallel to guides 24 and 26. The axis 140 is movable in a slotted hole 142 in the sliding carriage 60 and 62 so that the electrodes can be placed in and removed from their operative position. A vertical position adjusting device 144 in the form of a setting screw serves for adjusting the vertical position of the electrodes 122 and 124.

In order to insure that the electrodes are applied against approximately diagonally juxtaposed points on the spacer frame 126, the electrode 122 that is displaceable along the guide 24 is applied on the spacer frame 126 approximately parallel to the supporting surface whereas the electrode 24 movable along the guide 26 engages the spacer frame 126 approximately perpendicularly. By this arrangement it is insured that the path of electric current from one electrode to the other is the same on both halves of the spacer frame.

The sensors 56 and 58 of the length determining device 22 are designed so as to assist also in positioning the electrodes 122 and 124 on the spacer frame 126 disposed between the glass sheets 74 and 128.

Referring again to FIG. 5, the supporting frame 8 for the compression plate 10 includes pillars 150 having guiding surfaces 148. The compression plate 10 has lateral supporting rollers 126 engaging the guiding surfaces 148. The parallel guiding construction 12 is designed as a parallelogram guiding structure that comprises pairs of rocking levers 152 and 154 arranged respectively on opposite sides of the compression plates 10 and linked together by coupling rods 156 and 158. Rocking levers 152 and 154 assigned to respective sides of the plate are mutually connected by an untwistable connecting member 160. Approximately in the middle of each rocking lever 152 and 154 a further rocking lever 162 and 164 is hinged and pivotably connected to the supporting frame 8.

The lifting and lowering device 14 used for actuating the compression plate 10 is hydraulically operated and includes a piston-cylinder unit 166 mounted on the compression plate 10. Piston rod 168 cooperates with supporting rods 170 supported on springs 172 that are arranged in cylinders 174 and intercept the weight of the compression plate. The supporting rods project downwardly from the cylinders 174 and carry a stop member 120 that cooperates with the limit switch 118 of the length determining device 22. The stop member 120 and the limit switch 118 cooperating with the driving unit for the lifting and lowering device 14 form together the adjusting device 18 for adjusting the compressing force. The limit switch 118 is controlled by the length determining device 22 and responds to the movement of supporting springs 172 in the pressure relieving direction. The pressure relief takes place upon the abutment of the compressing plate against an insulating glass plate blank (consisting of two glass sheets 74 and 79 and a spacer frame 126 sandwiched therebetween), and upon the discharge of the pressure fluid from the piston-cylinder unit 166. Due to the successive discharge of the pressure fluid the supporting springs 72 can be successively relieved and press the supporting rods 170 and therewith the piston rods 168 upwardly so that the stop 120 is lifted. As a result the compression plate is released from the counter force and exerts an increasing compressing force against the insulating glass plate blank. The compressing force increases until the supporting springs 172 are completely relieved so that the entire weight of the compression plate 10 rests on the insulating glass plate blank. If a smaller compressing force is desired, the discharge of the pressure fluid from the piston-cylinder unit 166 has to be reduced prior to the relieving of the supporting springs 172. This control of the pressure fluid discharge is effected by means of the limit switch 118 that is displaced proportionally to the length of edges of the glass sheet determined by means of the length determining device 22; according to the displacement of the switch 118, the pressure fluid discharge from the piston-cylinder unit 166 is choked off by means of a suitable shut-off valve (not shown) as soon as the corresponding contact pressure is attained.

The device can be provided with a device for adjusting a predetermined clearance between the supporting table and the compressing plate. For this purpose, an additional sensor cooperating with an additional limit switch can be provided in the supporting table or on the compressing plate. The operative displacement of the sensor can be adjusted so as to influence the actuation of the lifting and lowering device.

The operation of the device of this invention is as follows:

At lifted compression plate 10, a glass sheet 74 is fed to a free side (without guides 22 and 24) of the supporting table 2 and travels on the air cushion of the table against the guides 24 and 26. Before the glass sheet reaches the corner 46, it actuates the sensor 50 that in turn via the actuating device 52 shuts off the air jet and thereby brakes the movement of the glass sheet so that the latter softly arrives to the guides 24 and 26. Thereupon, the compressing plate 10 is lowered, the blower 16 is actuated by means of switching device 17 for suction and the glass sheet is sucked up to the compressing plate 10. Thereupon pressure fluid is applied to the piston-cylinder unit 166 and the lifting and lowering device 14 lifts the compression plate together with the adherent glass sheet 74. During this movement another glass sheet 128 with an adhered spacer frame 126 is fed on the supporting table in a similar manner as the aforementioned glass plate 74. As soon as the compressing plate 10 attains its raised position, sensors 56 and 58 on sliding carriages 60 and 62 are moved between the compression plate 10 and the supporting table 2 and the driving motors 66 and 68 start displacing the sliding carriages 60 and 62. Simultaneously the sensors 56 and 58 scan the buttons surface of the compression plate 10 along the glass sheet 74. As soon as the sensors 56 and 58 determine the length of the glass sheet, the driving motors 66 and 68 are shut off and the sensors 56 and 58 are withdrawn by means of actuating members 76. By the displacement of the sliding carriages 60 and 62, the summing device 82 has been activated and the limit switch 118 has been lowered by means of the threaded spindle 114 proportionally with the displacement of the sliding carriages.

Upon the withdrawal of sensors 56 and 58 by means of the actuation member 76, the compressing plate 10 is moved down whereby the pressure fluid is discharged from the piston-cylinder unit 166. As soon as stop 120 has actuated the limit switch 118, the desired contact pressure has been attained. At this moment the electrodes 122 and 124 are extended or driven out as far as to abut against the spacer frame 126. The actuation members 134 force the electrode portions 136 and 138 apart from one another so that the electrodes abut in a prestressed condition against the lower and the upper transverse beam of the spacer frame 126. By applying a current into the electrodes the spacer frame 126 becomes heated to such an extent that a solder provided on the spacer frame and the adjacent glass sheets is melted and the spacer frame is soldered to the glass sheets. Thereupon the current is interrupted and the electrodes 122 and 124 are withdrawn by means of the actuating member 130.

After a short time interval, during which the solder solidifies, the piston-and-cylinder unit 166 is re-actuated by the pressure fluid so that the compressing plate 10 moves up. Simultaneously, the sliding carriages are returned to their starting positions and the guiding rollers 28 of the guide 26 extending in discharging direction A are withdrawn by means of a retracting device 34 so that the finished insulating glass plate can be discharged and a new work cycle can begin. If the device of this invention is employed for manufacturing insulating glass plates having glued spacer frames, the soldering device 20 can be dispensed with. The length determining device 22 in this case is employed for adjusting the compressing force of the compressing plate only.

FIG. 10 shows schematically a modification of the parallel guiding structure 176 that includes two pairs of piston-cylinder units 180 and 182 arranged on a compressing plate 178. In this embodiment, two adjacent piston-cylinder units 180 are supported via their downwardly directed piston rods 184 on a stationary stand 186 whereas the other pair of piston-cylinder units 182 is suspended via the upwardly directed piston rods 184 on the stand 186. The corresponding pressure spaces 188 of juxtaposed piston-cylinder units are connected via conduits 190. Similarly, the corresponding pressure spaces 192 of two adjacent piston-cylinder units are connected via connecting conduits 194. The piston-cylinder units are filled with a hydraulic fluid and by means of this arrangement a simple parallel guiding structure for the compressing plate 178 is effected.

FIG. 11 shows schematically another embodiment of the lifting and lowering device 196 having a piston-cylinder unit 198 arranged on the compressing plate 200 whereby the piston rod 202 is mounted on a stationary stand 204. A hydraulic arrangement is employed for controlling the lifting and lowering movement of the compressing plate 200 and this arrangement is also used for adjusting the compressing force of the plate. Cylinder 206 used for supporting the compressing plate 200 has its interior space connected to a shut-off and switch-over valve 210 that in turn is controlled by an actuating member 208. The valve 210 in its normal position shuts off the flow from the cylindrical space 206; in a first actuated position the valve 210 connects the cylindrical space 206 to a supply reservoir 212 and in a second actuated position it connects the cylinder 206 to a pressure controlling valve 214. The pressure controlling valve 214 is controlled by means of an adjusting member 216 responding to the output of the length determining device. The adjusted pressure in the cylinder 206 determines the contact force of the compressing plate 200. A pump 220 connected to the cylindrical space 206 via a relief valve 218 serves for lifting the compressing plate 200 after the shut-off and switch-over valve 210 has been closed.

FIG. 12 shows schematically another embodiment of the lifting and lowering device in which compressing plate 224 is movably arranged on a stand 222 and is provided with two counterweights 226 that compensate the weight of the compressing plate 224 so that the compressing force is defined exclusively by the force of the lifting and lowering device 228. The device 228 includes a hydraulically operated piston-cylinder unit 230 operatively connected to the compressing plate 224. A hydraulic controlling device for the unit 230 includes a shut-off and switch-over valve 234 controlled by an actuating member 232. In the illustrated normal or rest position, the valve 232 shuts off both the cylindrical space 236 connected for lifting the compressing plate, and the cylindrical space 238 for lowering the compressing plate. In a first (left-hand) actuated position the valve 234 connects the cylindrical space 238 to a pump 240 and the cylindrical space 236 is connected via a biassed relief valve 242 to a storage reservoir 246. As a result, the pump 240 supplies pressure fluid in the cylindrical space 238 whereby cylindrical space 236 due to its connection by the relief valve 242 to the supply reservoir provides counterpressure for regulating the movement of the piston of the unit 230. A pressure controlling valve 250 is arranged in the conduit 248 leading into the cylindrical space 238. The pressure of the control valve 250 is adjusted by means of an adjusting member 252 in response to the output of the length determining device described above. In this manner the force lowering the compressing plate and thus the contact pressure of the plate is adjusted. In a second (right-hand) position of the shut-off and switch-over valve 234, the pump 240 is connected to the cylindrical space 236 and the connection between the cylindrical space 238 and the pump 240 is interrupted. For lifting the compressing plate the cylindrical space 238 is connected via a pressure controlling valve 250 with the supply reservoir 246.

Figure 13:
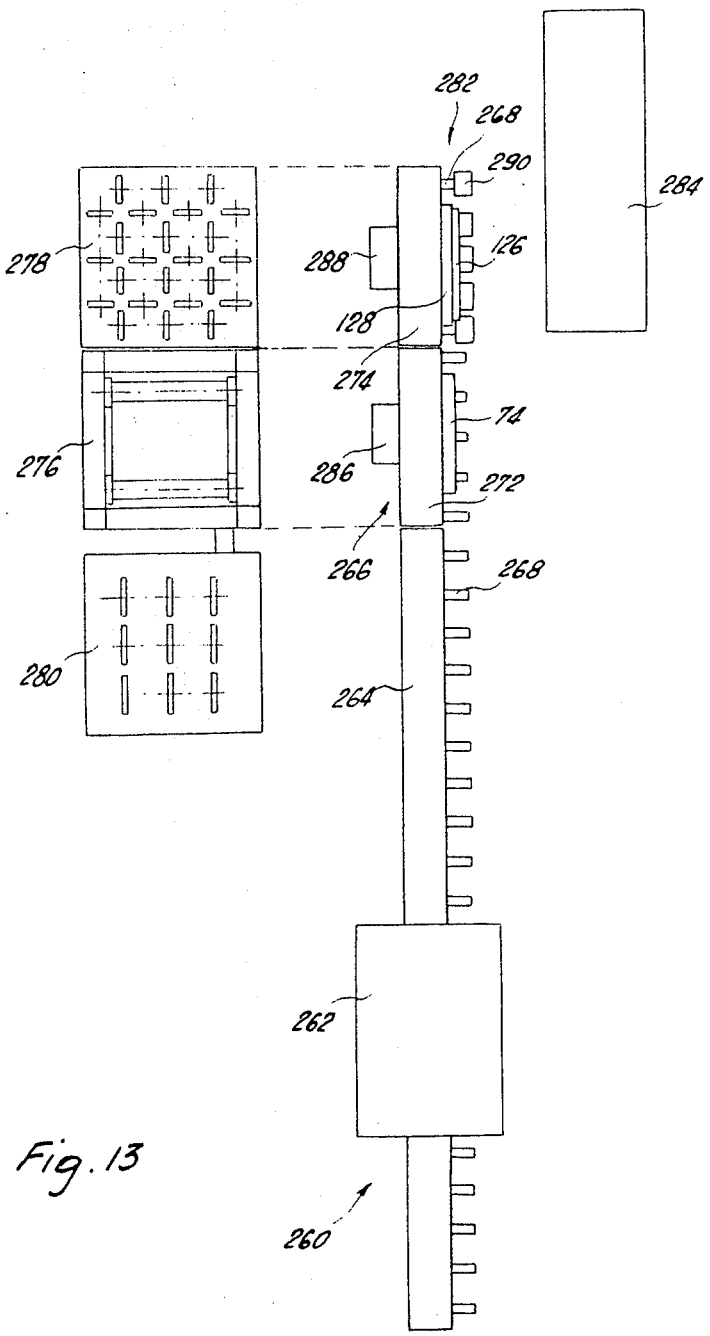
FIG. 13 is a schematic top view of an assembly for manufacturing the insulating glass plate.

FIG. 13 shows an installation for manufacturing insulating glass plates including the device of this invention. The installation includes a conveying or feeding track 260 that feeds in horizontal direction upright glass sheets travelling from a washing device 262 through a buffer section 264, onto a tilting table 266. The feeding track 260 includes lower conveying rollers 268 the axes 270 of which are arranged transversely to the feeding track (see FIGS. 14 and 15). The tilting table 266 includes receiving parts 272 and 274 arranged side-by-side for receiving respective glass sheets. In horizontal position of the tilting table the receiving parts 272 and 274 cooperate with a device 276 for assembling the insulating glass sheets and communicate with a guiding table 278. The device 276 is designed not only for assembling the sheets and frames into a glass plate blank but also for compressing those preassembled parts. The outlet of the device 276 is connected to a receiving table 280 where finished insulating glass plates are discharged. In the event that the device 276 is designed only for preassembling the glass sheets and frames, a separate compressing unit has to be arranged between the device 276 and the receiving table 280. The receiving parts 274 of the tilting table that cooperates with the guiding table 278 is constructed as an assembling device 282 for spacer frames that are prefabricated in the unit 284. In a variation, also the guiding table 278 can be constructed as an assembling device for the spacer frame.

Each receiving part 272 and 274 of the tilting table 266 can be provided with its own drives 286 and 288 operable for transporting the individual glass sheets. Preferably, the receiving parts 272 and 274 can be tilted together but if desired they can be tilted also separately. The tilting table is designed so that the incoming individual glass sheets are forwarded transversely to the direction of feeding either onto the guiding table 278 or to the device 276 for assembling the insulating glass plate blanks. For controlling the feeding and discharging of the individual glass sheets and for controlling the tilting of the table 266, controlling devices and limit switches of any suitable type known per se are employed.

Figure 14:
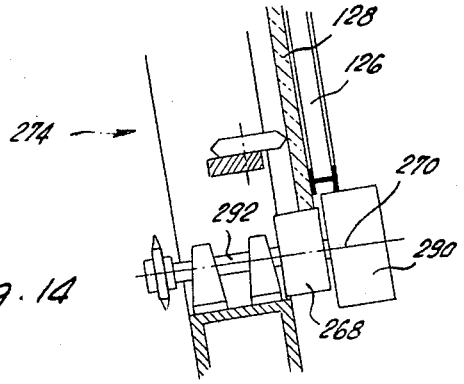
FIG. 14 is a stop device of a receiving part of a tilting table designed for preassembling the insulating glass plates.
Figure 15:
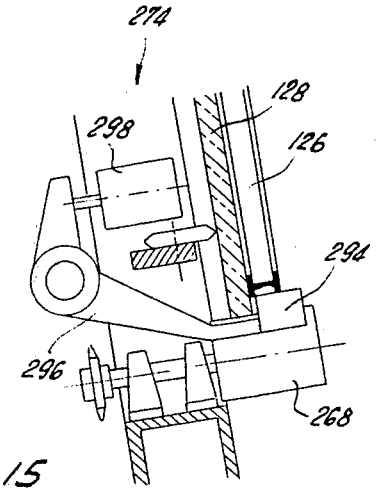
FIG. 15 is another embodiment of the stop device for the receiving part of a tilting table of FIG. 14.

The receiving part 274 adapted to serve as an assembling device 282 includes stop means the structure of which is illustrated in greater detail in FIGS. 14 and 15. In the embodiment shown in FIG. 14 the stopping device consists of a guiding roller 290 arranged for free rotation on a shaft 292 that also supports a driven conveyor roller 268. A glass sheet 128 is supported on the conveyor 268 and the spacer frame 126 is supported on the guiding roller 290. As shown in FIG. 15, the stopping device consists of a stop 294 arranged on an arm of a bent lever 296 and is swingable into and out of the space between the conveyor rollers 268. Provided that glass sheets are to be glued to the spacer frame, so the adhesive is applied on the spacer frame only. If the spacer frame is of metal and is to be soldered to the glass sheets, the soldering operation takes place on the assembling device 282 where the spacer frame is secured to the glass sheets by soldered stitches.

The operation of the installation for manufacturing the insulating glass plates is as follows:

The individual glass sheets 126 set up in pairs are first successively washed up in a washing device 262 and thereafter conveyed to the buffer section 264. If the tilting table 266 is in its vertical position as shown in FIG. 13, the glass sheets travel one after the other onto the receiving parts 272 and 274 of the tilting table until stop means (not shown) disconnect the drives 286 and 288 for the conveyor rollers 268. Spacer frames 126 prepared in the manufacturing unit 284 are laid upon the glass sheets 128 whereby the guiding roller 290 determines the vertical position of the spacer frames on the glass sheets. Thereafter, the tilting table 266 is tilted either manually or automatically. As soon as the receiving parts 272 and 274 of the tilting table 266 assume their horizontal position and the device 276 for assembly of the insulating glass plate blanks is ready, the receiving parts 272 and 274 deliver the glass sheets 74 and 128 to the device 276 and to the guiding table 278. The device 276 for assembling the insulating glass plate blanks operates in the manner as has been described above. After placing a glass sheet in position, in the device 274, the sheet is lifted so that a subsequent glass sheet 128 provided with the spacer frame 126 is delivered from the guiding table 278 into the device 276 and is placed in a proper position therein. By lowering the previously lifted glass sheet 74 the same is brought into contact with the spacer frame and if the latter is provided with an adhesive agent, it is sufficient to compress the preassembled blank to produce the finished glass plate. If the glass sheets 74 and 128 are to be connected to the spacer frame 126 by soldering, this can also be effected in the device 276 in the previously described manner. The finished insulating glass plates are then discharged from the device 276 on the receiving table 280.

The installation as illustrated in FIG. 13 has a particularly simple structure and enables an economic operation of the manufacturing process even when it does not work to its full capacity.

It will be understood that each of the elements described above, or two or more together, may also find a useful application in other types of constructions differing from the types described above.

While the invention has been illustrated and described as embodied in specific examples, it is not intended to be limited to the details shown, since various modifications and structural changes may be made without departing in any way from the spirit of the present invention.

What is claimed as new and desired to be protected by Letters Patent is set forth in the appended claims:

1. A device for manufacturing insulating glass plates assembled of at least two superposed glass sheets spaced apart by a spacer frame, comprising a supporting table for supporting a glass sheet in a horizontal plane; a compressing plate mounted for lifting and lowering movement above said supporting table, means for producing a suction effect on the lower surface of said compressing plate, means for measuring the lengths of adjacent edges of the incoming glass sheet, means for adjusting contact pressure of said compressing plate in response to the measured lengths, and retractable guiding means arranged at two adjacent sides of said table for guiding a glass sheet.

2. A device as defined in claim 1, further including a soldering device having at least two electrodes adapted for contacting a spacer frame disposed between two glass sheets.

3. A device as defined in claim 1, further including a retracting device for vertically withdrawing said guiding means from the plane of said supporting table.

4. A device as defined in claim 1, wherein said guiding means include respectively a plurality of guiding rollers, each guiding roller being spring biassed into an operative position above the plane of said supporting table and being retractable from said operative position.

5. A device as defined in claim 4, wherein at least a part of said guiding rollers arranged in the discharging direction of said glass sheets are positively driven.

6. A device as defined in claim 1, further including means for producing an air cushion on said supporting table.

7. A device as defined in claim 6, further including means for braking the movement of the incoming glass sheet.

8. A device as defined in claim 1, wherein said means for measuring the length of edges of the incoming glass sheet include a plurality of sensors arranged along at least one side of said supporting table, said sensors being responsive to the presence of said glass sheet and the number of actuated sensors being an indication of the length of the incoming glass sheet.

9. A device as defined in claim 8, wherein the means for determining the length of the incoming glass sheet includes a summing device for summing the measured length of two adjacent edges of the incoming glass sheets.

10. A device as defined in claim 1, wherein said means for determining the length of edges of incoming glass sheets includes at least one sensor displaceable along one edge of the supporting table.

11. A device as defined in claim 10, wherein the starting position for said sensor is at the entrance area of the supporting table whereby the displacement of said sensor is an indirect measure of the length of the incoming sheet.

12. A device as defined in claim 10, wherein a signal generator cooperates with said sensor to transmit a succession of signals the number of which is indicative of the measured length of the incoming glass sheet.

13. A device as defined in claim 1, further including a parallel guiding structure for guiding said compressing plate in a parallel position relative to said supporting table.

14. A device as defined in claim 13, wherein said parallel guiding structure includes parallelogram guiding means supported on pillars of a stationary stand.

15. A device as defined in claim 14, wherein said parallelogram guiding means includes a plurality of pairs of rocking levers arranged on opposite sides of the compressing plate, said pairs being coupled to each other by means of coupling members.

16. A device as defined in claim 1, further including means for lifting and lowering the compressing plate and means for adjusting the contact pressure of said compressing plate.

17. A device as defined in claim 16, wherein said adjusting means includes counterweights connected to said compressing plate to neutralize the weight of the latter.

18. A device as defined in claim 17, wherein said lifting and lowering means for said compressing plate includes hydraulic piston-and-cylinder units and said adjusting means for adjusting the contact pressure of said contacting plates includes a supporting spring and a limit switch responding to the extension of a spring.

19. A device as defined in claim 17, further including pressure controlling valves connected to the cylinders of said piston-and-cylinder units, the operative pressure for said pressure control valve being controlled by said means for determining length of said incoming glass sheets.

20. A device as defined in claim 19, further including a shut-off and switch-over valve connecting in a first position thereof said piston-and-cylinder unit to supply a reservoir of pressure fluid and in a second position thereof to a pressure relief valve.

21. A device in claim 1, wherein said suction means includes a suction blower communicating with the lower surface of said compressing plate for lifting a glass sheet from said supporting table.

22. A device as defined in claim 1, wherein said suction means includes a switching device for shutting off the suction air and for applying a blow air on said compressing plate.

23. A device as defined in claim 1, further including a device for adjusting a predetermined clearance between said supporting table and said compressing plate.

24. A device as defined in claim 23, wherein said clearance adjusting device includes a sensor cooperating with a limit switch.

25. A device as defined in claim 1, further including a feeding track for individual glass sheets, a washing device arranged on said feeding track, means for feeding spacer frames between respective glass sheets and means for feeding said glass sheets and spacer frames onto said supporting table.

26. A device as defined in claim 25, wherein said means for feeding spacer frames includes a tilting table including two receiving parts arranged side-by-side for receiving respective glass sheets, and a guiding table cooperating with said tilting table for guiding said glass sheets and said spacer frames onto said supporting table.

27. A device as defined in claim 26, wherein one of said receiving parts of said tilting table feeds said spacer frames between said glass sheets.

28. A device as defined in claim 26, wherein said guiding table positions said spacer frame between said glass sheets.

29. A device as defined in claim 26, wherein said compressing plate assists in assembling an insulating glass plate blank and subsequently compresses said blank into a finished insulating glass plate.

30. A device as defined in claim 25, wherein an assembling device for assembling insulating glass plate blanks is disposed between said guiding table and said supporting table.

31. A device for manufacturing insulating glass plates, comprising a supporting table for supporting a glass sheet in a horizontal plane; a compressing plate mounted for lifting and lowering movement above said supporting table; means for braking the movement of the incoming glass sheet; said breaking means including a valve for shutting off the blow air forming an air cushion on said supporting table, and at least one sensor of movement of the incoming glass plate for controlling said valve.

32. A device for manufacturing insulating glass plates, comprising a supporting table for supporting a glass sheet in a horizontal plane; and a compressing plate mounted for lifting and lowering movement above said supporting table; means for adjusting contact pressure of said compressing plate; means for measuring the length of adjacent edges of the glass sheet; said means for measuring the length of edges of the incoming glass sheet including a plurality of sensors arranged along at least one side of said supporting table, said sensors being responsive to the presence of said glass sheet and the number of actuated sensors being an indication of the length of the incoming glass sheet, a summing device for summing the measured length of two adjacent edges of the incoming glass sheets, each sensor being provided with a drive having a rotary driving member, and said summing device being in the form of a summing differential gear coupled to respective drives, said gear driving a threaded spindle, and said spindle supporting a threaded nut for displacing a limit switch along a path proportional to the summed up value of the length of said edges.

33. A device for manufacturing insulating glass plates, comprising a supporting table for supporting a glass sheet in a horizontal plane; and a compressing plate mounted for lifting and lowering movement above said supporting table; means for adjusting contact pressure of said compressing plate; means for measuring the length of adjacent edges of the glass sheets including at least one sensor displaceable along one edge of the supporting table, and a summing device for summing the measured length of said adjacent edges, said sensors being arranged respectively on a sliding carriage that is displaceable between a first position outside the area between said supporting table and said compressing plate and a second position within said area.

34. A device as claimed in claim 33, wherein each sliding carriage supports a soldering electrode adapted for contacting and soldering a spacer frame disposed between two glass sheets.

35. A device as defined in claim 34, wherein the starting position of the movement of said electrodes is at the entrance edges of said supporting table.

36. A device as defined in claim 34, wherein the movement of said electrodes is controlled by an hydraulic actuating member.

37. A device as defined in claim 36, wherein each electrode includes two separable electrode portions that are spring biassed into contact with one another and controllable by a hydraulic actuating device to separate in the vertical direction.

38. A device according to claim 37, wherein each electrode is arranged for tilting movement about a horizontal axis extending substantially parallel to a guiding edge of said supporting table and including means for adjusting the vertical position thereof.

39. A device as defined in claim 38, further including means for applying said electrodes under a predetermined pressure against the spacer frame.

40. A device as defined in claim 39, further including a limit switch cooperating with the summing device of said means for determining the length of the incoming glass sheet.

41. A device as defined in claim 39, further including means for applying one electrode substantially perpendicularly to said spacer frame and the other electrode substantially horizontally to a diagonally juxtaposed point on said spacer frame in such a manner that partial current circuits between said electrodes are at least partially symmetrically distributed on said spacer frame.

42. A device as defined in claim 41, wherein a separate drive and a sensor is assigned to each electrode for controlling the movement thereof.

43. A device as defined in claim 42, wherein the sensors of said means for determining the length of incoming glass sheets control the movement of the electrodes arranged on the same sliding carriage.

44. A device as defined in claim 43, wherein said means for determining the length includes at least one cam for depressing guiding rollers for the incoming glass sheet.

* * * * *